US006332418B2

(12) United States Patent
Hayashi

(10) Patent No.: US 6,332,418 B2
(45) Date of Patent: Dec. 25, 2001

(54) SEWING MACHINE NEEDLE PLATE AND FEED DOGS

(75) Inventor: Masanori Hayashi, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/814,832

(22) Filed: Mar. 23, 2001

(30) Foreign Application Priority Data

Apr. 28, 2000 (JP) ..... 12-128727

(51) Int. Cl.[7] ..... D05B 73/12; D05B 27/08
(52) U.S. Cl. ..... 112/260; 112/324; 112/312
(58) Field of Search ..... 112/312, 260, 112/323, 324

(56) References Cited

U.S. PATENT DOCUMENTS

| | | | | |
|---|---|---|---|---|
| 4,072,116 | * | 2/1978 | Nagy | 112/286 |
| 4,430,878 | * | 2/1984 | Dispennett et al. | 112/260 |
| 4,934,293 | * | 6/1990 | Yokota et al. | 112/288 |
| 5,311,831 | * | 5/1994 | Fieschi | 112/288 |

* cited by examiner

*Primary Examiner*—Ismael Izaguirre
(74) *Attorney, Agent, or Firm*—Jones, Tullar & Cooper, P.C.

(57) ABSTRACT

A sewing machine related to the present invention comprises a needle plate and feed dogs. A second feed dog slot provided at the cloth send-in side of a portal shaped needle hole of the needle plate is shifted to the right side from the center of the portal shaped needle hole. The left side first feed dog slot is extending toward the second feed dog slot side in the cloth send-in side of the portal shaped needle hole, so as to be formed a wide breadth portion from side to side. A first cross-piece of the needle plate is disposed between the wide breadth portion and a needle drop portion of the portal shaped needle hole, and a second cross-piece of the needle plate is disposed between the second feed dog slot and said needle drop portion. The first cross-piece is formed wider in the cloth feed direction than the second cross-piece. A differential feed dog disposed in the cloth send-in side of the needle drop portion is composed in a shape combining each feed dog slots. Therefore the cloth can be fed so as not to deviate in the lateral positions of the cloth end, and the spacing margin between the outlet seam end and the seam is controlled at a specified level, so that a sewn product of excellent appearance is obtained.

3 Claims, 5 Drawing Sheets

SEWING MACHINE NEEDLE PLATE AND FEED DOGS

BACKGROUND OF THE INVENTION

1. Field of the Invention

The present invention relates to a sewing machine used in hemming of J-shaped folded cloth.

2. Description of the Related Art

Usually, a sewing machine used in hemming of J-shaped folded cloth comprises, as shown in FIG. 4, a needle plate 102 having a portal shaped needle hole 100 and the feed dog slots 104, 105, 106, and the feed dogs (omitted in FIG. 4) projecting and retracting on the top of the needle plate 102 from the first to third feed dog slots 104, 105,106. The portal shaped needle hole 100 has two needle drop portions 100*b* through which two needles 100*a* (see FIG. 5) pass. The first feed dog slots 104,104 of the needle plate 102 are disposed at the right and left side across the portal shaped needle hole 100, each extending before and after the portal shaped needle hole 100 in a state parallel to the cloth feed direction F. The second feed dog slots 105,105 of the needle plate 102 are a pair disposed at the right and left side ahead of the portal shaped needle hole 100 in the cloth feed direction F. The third feed dog slots 106,106 are a pair disposed at right and left side behind the portal shaped needle hole 100 in the cloth feed direction F. The J-shaped folded cloth set on the needle plate 102 is fed in the cloth feed direction F by means of the feed dogs.

In the conventional sewing machine having the needle plate 102 and the feed dogs projecting and retracting from the feed dog slots 104, 105, 106, when the feed dogs descend, a cloth end Wb of the folded portion Wa of the J-shaped folded cloth W as shown in FIG. 5 drops into the left side second feed dog slot of the pair of right and left second feed dog slots 105,105 and the dropping state continues until just before the portal shaped needle hole 100. Accordingly, the cloth end Wb of the folded portion Wa is deviated in lateral position with respect to the needle plate 102. In this lateral position deviated state, if the folded portion Wa of the J-shaped folded cloth W is sewn near the cloth end Wb, as shown in FIG. 5, the spacing margin between the outlet seam end Wbb of the folded portion Waa sewn to the cloth main body WW and the seam S is not constant, and a corrugated state is formed, and the appearance of the sewn product is impaired. Besides, the cloth end Wb dropping into the left side second feed dog slot is sent by following up the side end 105*a* of the left side second feed dog slot, and, as a result, the spacing between the outlet seam end Wbb and the seam S is not as specified.

SUMMARY OF THE INVENTION

The invention is devised in the light of the above problems, and it is hence an object thereof to present a sewing machine capable of feeding the cloth by stabilizing the lateral positions of the cloth end of the folded portion when hemming the J-shaped folded cloth, and controlling the spacing between the outlet seam end of folded portion sewn to the cloth main body and the seam at a specified level so as to obtain a sewn product of excellent appearance.

To achieve the object, the sewing machine of the present invention comprises a needle plate and feed dogs. The needle plate includes a portal shaped needle hole having a needle drop portion, a pair of first feed dog slots disposed at right and left side across the portal shaped needle hole extending back and forth in the cloth feed direction of the portal shaped needle hole, a second feed dog slot disposed ahead in the cloth feed direction of the portal shaped needle hole, and a third feed dog slot disposed behind in the cloth feed direction of the portal shaped needle hole. A presser foot is disposed above the needle plate, and feed dogs move in and out from the feed dog slots of the needle plate so as to feed the J-shaped folded cloth.

As the feature of the needle plate used in this sewing machine, first, the second feed dog slot is disposed at the nearer side of the portal shaped needle hole being shifted to the right side first feed dog slot side from the center of the portal shaped needle hole, and the left side first feed dog slot of the pair of right and left first feed dog slots is extending toward the second feed dog slot side ahead in the cloth feed direction of the portal shaped needle hole, so as to be formed in a shape wide in the lateral direction. A first cross-piece of the needle plate disposed between the groove of the wide shape and the needle drop portion of the portal shaped needle hole is formed wider in the cloth feed direction than a second cross-piece of the needle plate disposed between the second feed dog slot and the needle drop portion of the portal shaped needle hole. The feed dog is composed of a main feed dog disposed in each feed dog slot behind in the cloth feed direction from the needle drop portion of the portal shaped needle hole, and a differential feed dog disposed in each feed dog slot ahead in the cloth feed direction from the needle drop portion of the portal shaped needle hole, and each differential feed dog is composed in a shape combining the first feed dog slot and second feed dog slot.

According to the present invention, when the J-shaped folded cloth is put onto the needle plate of the sewing machine, the folded cloth is fed in the cloth feed direction by collaborative action of the differential feed dog and the presser foot. At this time, the second feed dogs lot is disposed as being shifted to the right side first feed dog slot side from the center of the portal shaped needle hole, a wide slot extending from the left side first feed dog slot is formed in the needle plate portion before the portal shaped needle hole by this shifting, and the differential feed dog is formed in the shape of combining the first feed dog slot including this wide slot and second feed dog slot, and therefore the cloth can be fed securely without causing deviation in the lateral position due to drop of the cloth end of the folded portion of the J-shaped folded cloth in the second feed dog slot before the needle drop portion. Further, when the folded cloth is fed forward to just before the needle drop portion of the portal shaped needle hole, the cloth end of the folded portion is securely supported by the first cross-piece formed widely in the cloth feed direction, and the cloth can be fed up to the needle drop portion while maintaining the specified lateral position without the cloth end being fed along the side end of the second feed dog slot.

Thus, when hemming a J-shaped folded cloth, it is capable of feeding the cloth by stabilizing the lateral positions of the cloth end of the folded portion, and controlling the spacing between the outlet seam end of folded portion sewn to the cloth main body and the seam at a specified level, and therefore it is effective to obtain a sewn product of excellent appearance.

PREFERRED EMBODIMENT OF THE INVENTION

A preferred embodiment of the present invention is described below while referring to the accompanying drawings.

Figure 1:
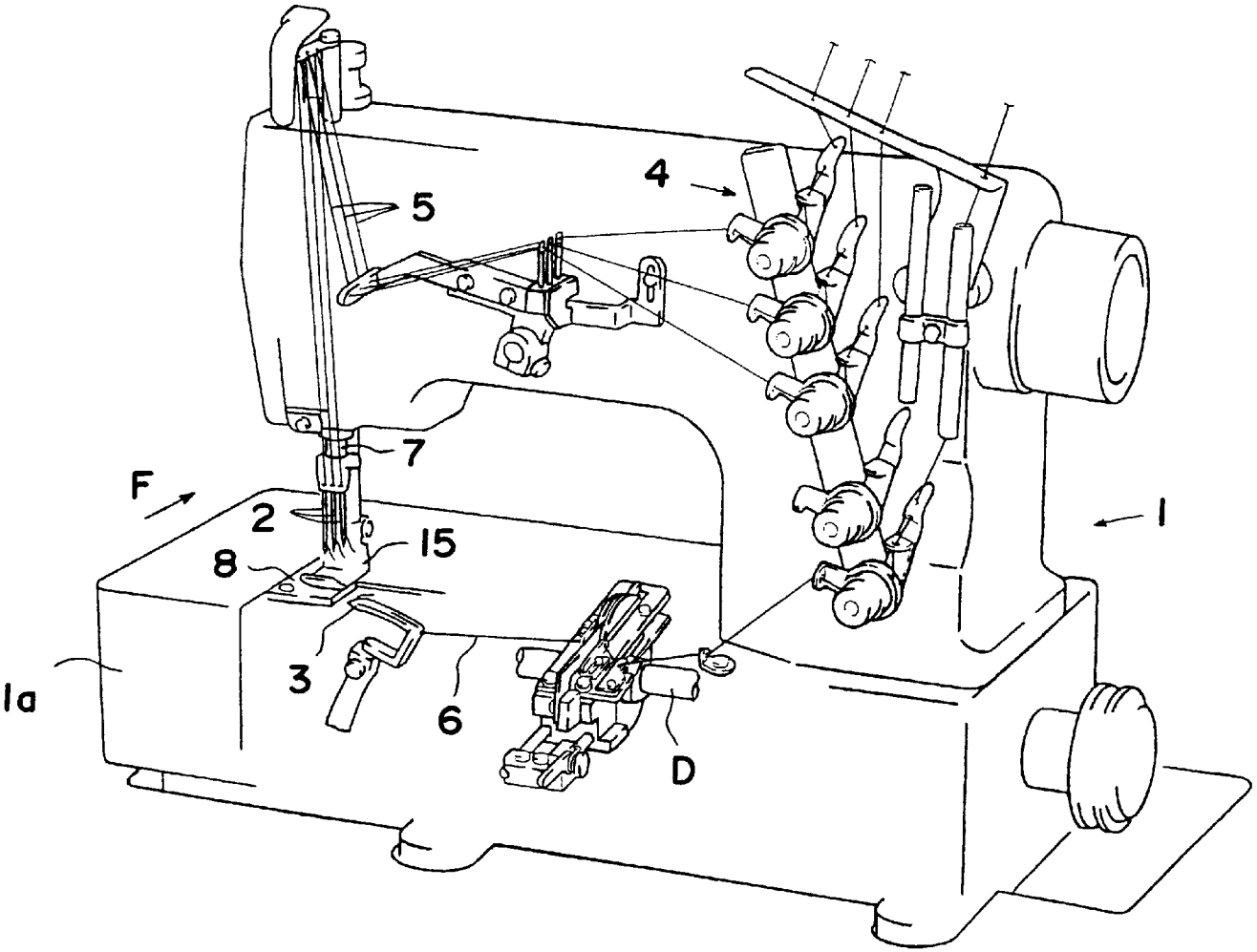
FIG. 1 is a perspective appearance view of a double-chain stitch sewing machine applied in the present invention.

FIG. 1 is a perspective appearance view of a sewing machine applied in the present invention. This sewing machine 1 is a double chain stitch sewing machine having three needles 2 and one looper 3. The sewing machine forms a seam S related to the stitch type 407 on the J-shaped folded cloth W (see FIG. 3) by means of three needle threads 5 supplied into each needle 2 from a thread source (not shown) through a thread tensioning device 4, and one looper thread 6 supplied into the looper 3 through the same thread tensioning device 4. Each needle 2 is fitted to a needle bar 7 which moves up and down in working with a sewing machine main shaft D, and penetrates through three needle drop portions 9*a*, 9*b*, 9*c* of the portal shaped needle hole 9 (see FIG. 2) of the needle plate 8 fixed to the bed portion la of the sewing machine 1. The looper 3 is mounted on the looper shaft (not shown) oscillating in working with the sewing machine main shaft D, and moves reciprocally right and left beneath the needle plate 8. Above the needle plate 8, there is a presser foot 15 for pressing the folded cloth W onto the needle plate 8.

Figure 2:
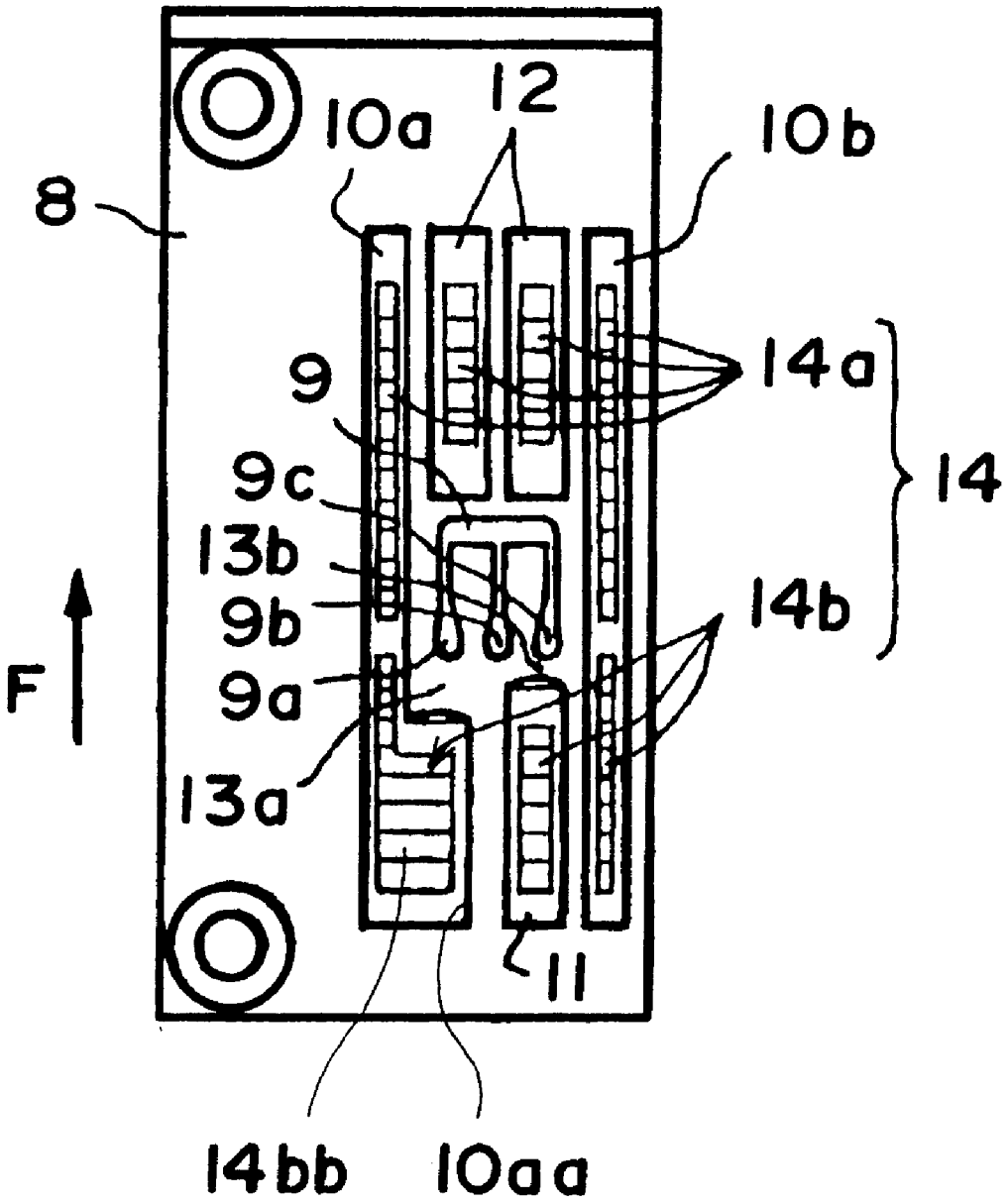
FIG. 2 is a magnified plan view showing a needle plate of said sewing machine.

The needle plate 8 includes, as shown in FIG. 2, a portal shaped needle hole 9, a pair of first feed dog slots 10*a*, 10*b*, one second feed dog slot 11 and a pair of third feed dog slots 12,12. The portal shaped needle hole 9 has three needle drop portions 9*a*, 9*b*, 9*c*. The pair of first feed dog slots 10*a*, 10*b* is disposed at right and left side across the portal shaped needle hole 9, and extends before and after the cloth feed direction F of the portal shaped needle hole 9. The second feed dog slot 11 is disposed ahead in the cloth feed direction F of the portal shaped needle hole 9. The third feed dog slots 12,12 are disposed behind in the cloth feed direction F of the portal shaped needle hole 9.

The second feed dog slot 11 is shifted in one of the lateral direction from the center of the portal shaped needle hole 9, and is disposed specifically ahead in the cloth feed direction of the right side needle drop portion 9*c* of the three needle drop portions 9*a*, 9*b*, 9*c*. Of the first feed dog slots 10*a*, 10*b*, the left side first feed dog slot 10*a* is extended toward the second feed dog slot 11 side ahead in the cloth feed direction of the portal shaped needle hole 9 so as to form a wide breadth portion 10*aa* from side to side. A first cross-piece 13*a* of the needle plate 8 is disposed between the wide breadth portion 10*aa* and the left side needle drop position 9*a* of the portal shaped needle hole 9. The first cross-piece 13*a* is formed more widely in the cloth feed direction F than a second cross-piece 13*b* of the needle plate 8 disposed between the second feed dog slot 11 and the right side needle drop position 9*c* of the portal shaped needle hole 9.

This double-chain stitch sewing machine 1 further comprises a feed dog 14 which moves in and out from the feed dog slots 10*a*, 10*b*, 11, 12, said feed dog 14 feeds the folded cloth W in the cloth feed direction F. This feed dog 14 is composed of main feed dogs 14*a* disposed behind the cloth feed direction F from the needle drop portions 9*a*, 9*b*, 9*c* of the portal shaped needle hole 9, and differential feed dogs 14*b* disposed ahead in the cloth feed direction F from the needle drop portions 9*a*, 9*b*, 9*c* of the portal shaped needle hole 9. The differential feed dogs 14*b* are formed in each shape conforming to the shape of the first feed dog slots 10*a*, 10*b* and second feed dog slot 11. That is, in the wide breadth portion 10*aa* of the first feed dog slot 10*a*, a wide breadth feed dog portion 14*bb* integrally extending from one of the differential feed dog is positioned.

In the double chain stitch sewing machine 1 having such configuration, the hemming operation is explained below.

When the J-shaped folded cloth W is put onto the needle plate 8 of the sewing machine 1, the folded cloth W is fed to above the portal shaped needle hole 9 in the cloth feed direction F by cooperation of the presser foot 15 and differential feed dogs 14*b*. At this time, the second feed dog slot 11 is disposed as being shifted to the right side first feed dog slot 10*b* side from the center of the portal shaped needle hole 9, and the wide breadth portion 10*aa* extended from the left side first feed dog slot 10*a* is formed in the portion of the needle plate 8 before the portal shaped needle hole 9 produced by this shifting, and the differential feed dogs 14*b* in a shape including the wide breadth feed dog portion 14*bb* are disposed in the shape of the first feed dog slot 10*a* including the wide breadth portion 10*aa* and second feed dog slot 11, and the right side first feed dog slot 10*b* extends before and after the cloth feed direction F of the portal shaped needle hole 9, so that the folded portion Wa of the J-shaped folded cloth W is securely fed to both cross-pieces 13*a*, 13*b* without being shifted in the lateral position.

Figure 3:
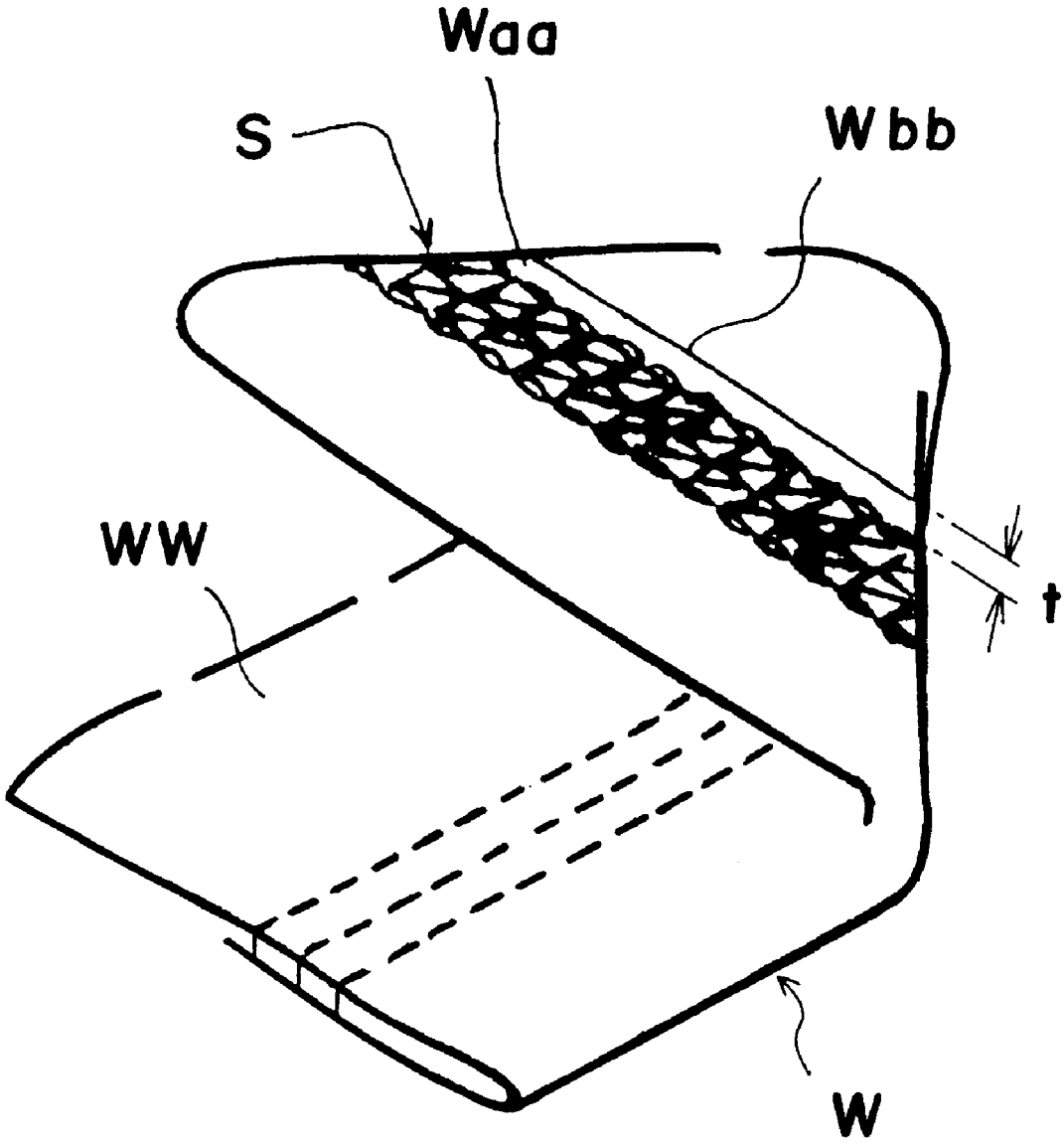
FIG. 3 is a perspective view of a sewn product hemmed by said sewing machine.
Figure 4:
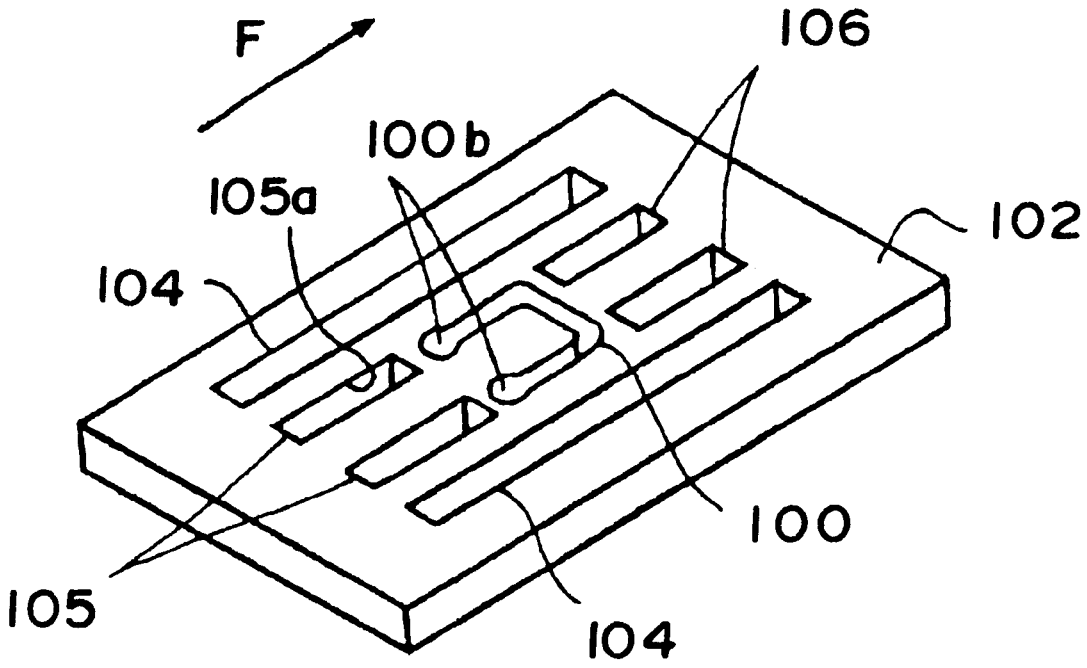
FIG. 4 is a magnified perspective view showing a needle plate of a conventional sewing machine.
Figure 5:
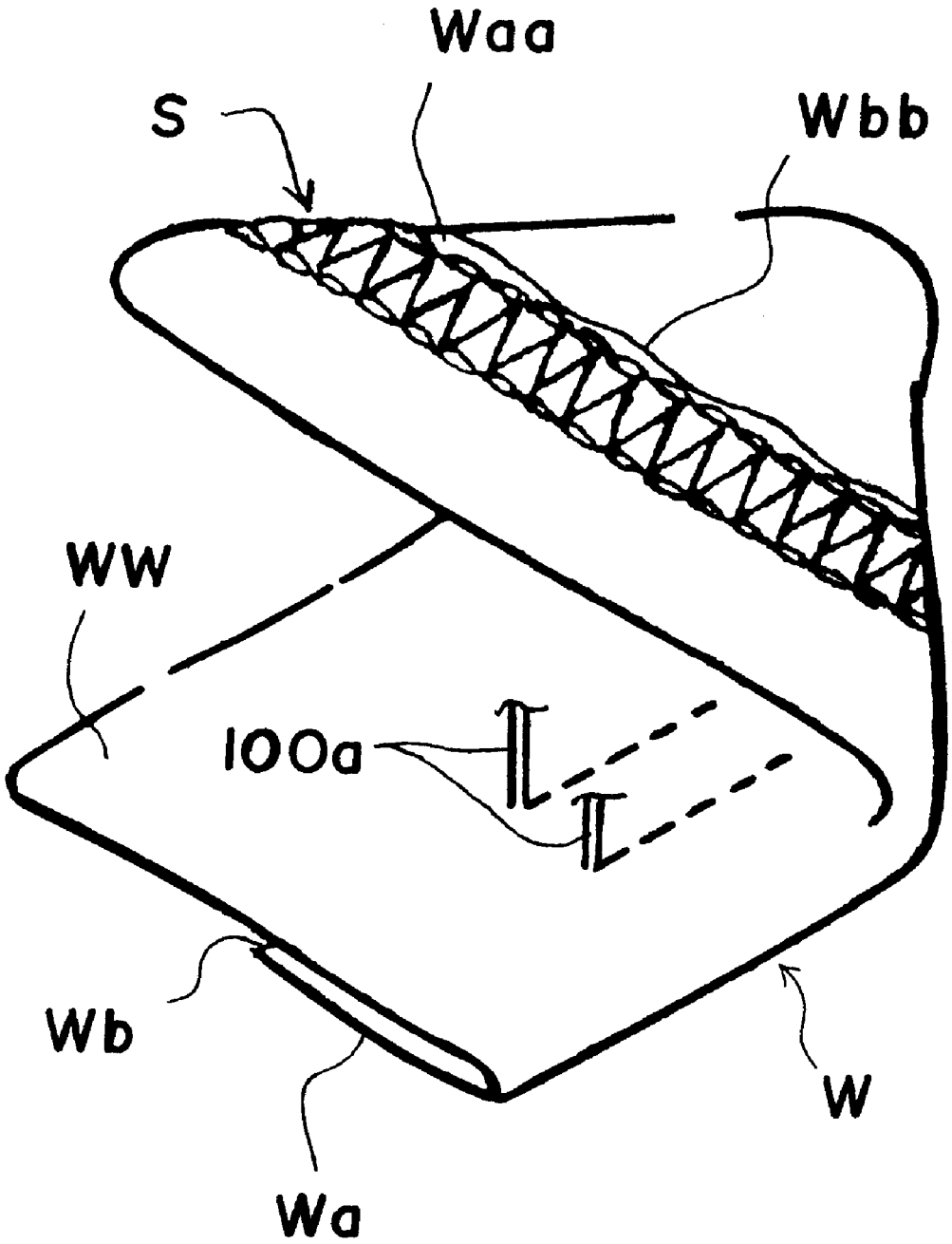
FIG. 5 is a perspective view of a sewn product hemmed by the conventional sewing machine.

When the cloth end Wb of the folded portion Wa of the J-shaped folded cloth W is fed to just before the portal shaped needle hole 9, the cloth end Wb of the folded portion Wa is securely held from beneath by the first cross-piece 13*a* formed widely in the cloth feed direction F, and hence the cloth end Wb of the folded portion Wa is not sent along the side of the second feed dog slot 11, and is sent onto the needle drop portions 9*a*, 9*b*, 9*c* while maintaining the specified lateral positions. It means that the folded portion Wa is straightly sent in the cloth feed direction F by the differential feed dog 14*b*. In particular, when the cloth end Wb of the folded portion Wa is sewn by the sewing machine 1 so as to protrude by a specified amount from the seam S, as shown in FIG. 3, the spacing margin t between the outlet seam end Wbb of the folded portion Waa sewn to the cloth main body WW and the seam S is constant, and the appearance of the sewn product is very excellent.

In the embodiment, the present invention is applied to the double-chain stitch sewing machine having three needles, but not limited to this, the present invention may be also applied to a double-chain stitch sewing machine having two needles, or a multi-needle flat seamer sewing machine, and the hemmed sewn products of excellent appearance as described herein are obtained.

The entire disclosure of Japanese Patent Application No. 2000-128727 filed on Apr. 28, 2000 including specification, claims, drawings and summary are incorporated herein by reference in its entirety.

What is claimed is:

1. A sewing machine comprising a needle plate having a portal shaped needle hole including a needle drop portion, a pair of first feed dog slots disposed at right and left side across the portal shaped needle hole extending back and forth in the cloth feed direction of the portal shaped needle hole, a second feed dog slot disposed ahead in the cloth feed direction of said portal shaped needle hole and a third feed dog slot disposed behind in the cloth feed direction of said portal shaped needle hole, a presser foot disposed above this needle plate, and feed dogs moving in and out from the feed dog slots of said needle plate so as to feed the J-shaped folded cloth, wherein said second feed dog slot is disposed ahead the nearer side of the portal shaped needle hole being shifted to the right side first feed dog slot side from the center of the portal shaped needle hole, and the left side first feed dog slot of said pair of right and left first feed dog slots is extending toward the second feed dog slot side ahead in the cloth feed direction of the portal shaped needle hole, so as to be formed a wide breadth portion from side to side, a first cross-piece of the needle plate is disposed between the wide breadth portion and the needle drop portion of the portal shaped needle hole, said first cross-piece is formed wider in the cloth feed direction than a second cross-piece of the needle plate disposed between the second feed dog slot and the needle drop portion of the portal shaped needle hole, said feed dog is composed of a main feed dog disposed in each feed dog slot behind the cloth feed direction from the needle drop portion of the portal shaped needle hole, and a differential feed dog disposed in each feed dog slot ahead in the cloth feed direction from the needle drop portion of the portal shaped needle hole, and each differential feed dog is composed in a shape combining the first feed dog slot and second feed dog slot.

2. The sewing machine of claim 1, wherein said second feed dog slot is a single one.

3. The sewing machine of claim 1, wherein three needles are provided, and the portal shaped needle hole of said needle plate has three needle drop portions corresponding to three needles, and said second feed dog slot is disposed before the cloth feed direction of the right side needle drop portion.

* * * * *